US007543383B2

(12) United States Patent
Patel et al.

(10) Patent No.: US 7,543,383 B2
(45) Date of Patent: Jun. 9, 2009

(54) METHOD FOR MANUFACTURING OF FUEL NOZZLE FLOATING COLLAR

(75) Inventors: Bhawan B. Patel, Mississauga (CA); Lorin Markarian, Etobicoke (CA); Melissa Despres, Verdun (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 161 days.

(21) Appl. No.: 11/782,234

(22) Filed: Jul. 24, 2007

(65) Prior Publication Data

US 2009/0025224 A1 Jan. 29, 2009

(51) Int. Cl.
*B21K 21/08* (2006.01)

(52) U.S. Cl. ..... 29/890.142; 29/890.14

(58) Field of Classification Search ..... 29/890.142, 29/889.2, 423, 527.1; 60/737, 748
See application file for complete search history.

(56) References Cited

U.S. PATENT DOCUMENTS

| | | | |
|---|---|---|---|
| 1,751,448 | A | 3/1930 | Campbell, Jr. |
| 2,468,824 | A | 5/1949 | Hughey |
| 2,669,090 | A | 2/1954 | Jackson |
| 2,694,245 | A | 11/1954 | Rogers et al. |
| 2,775,566 | A | 12/1956 | Crowley |
| 2,939,199 | A | 6/1960 | Strivens |
| 3,169,367 | A | 2/1965 | Hussey |
| 3,266,893 | A | 8/1966 | Duddy |
| 3,351,688 | A | 11/1967 | Kingery et al. |
| 3,410,684 | A | 11/1968 | Printz |
| 3,413,704 | A | 12/1968 | Addoms, Jr. et al. |
| 3,416,905 | A | 12/1968 | Waugh |
| 3,523,148 | A | 8/1970 | Boyer et al. |
| 3,595,025 | A | 7/1971 | Stöckel et al. |
| 3,608,309 | A | 9/1971 | Hill et al. |
| 3,615,054 | A | 10/1971 | La Botz |
| 3,698,849 | A | 10/1972 | Czerski |
| 3,704,499 | A | 12/1972 | Majkrzak et al. |
| 3,775,352 | A | 11/1973 | Leonard, Jr. |
| 3,782,989 | A | 1/1974 | Mansur |
| 3,888,663 | A | 6/1975 | Reichman |
| 3,889,349 | A | 6/1975 | Kaufman |
| 3,925,983 | A | 12/1975 | La Botz |
| 3,982,778 | A | 9/1976 | Spencer et al. |
| 4,011,291 | A | 3/1977 | Curry |
| 4,029,476 | A | 6/1977 | Knopp |
| 4,076,561 | A | 2/1978 | Lee et al. |

(Continued)

FOREIGN PATENT DOCUMENTS

| | | |
|---|---|---|
| CA | 983215 | 2/1976 |

(Continued)

OTHER PUBLICATIONS

"Medical Plant Tour: Metal injection molding smiles", Injection Molding Magazine, Aug. 2002, the 3rd paragraph.

(Continued)

*Primary Examiner*—Sam Chuan C Yao
*Assistant Examiner*—John Becker
(74) *Attorney, Agent, or Firm*—Ogilvy Renault LLP

(57) ABSTRACT

A floating collar is metal injected moulded with an excess portion intended to be separated, such as by shearing, from the reminder of the moulded floating collar to leave a chamfer thereon and/or remove injection marks.

6 Claims, 6 Drawing Sheets

U.S. PATENT DOCUMENTS 4,094,061 A 6/1978 Gupta et al.
4,197,118 A 4/1980 Wiech, Jr.
4,225,345 A 9/1980 Adee et al.
4,226,088 A 10/1980 Tsukahara et al.
4,236,923 A 12/1980 Takahashi et al.
4,246,757 A 1/1981 Heberling
4,274,875 A 6/1981 Cadle et al.
4,280,973 A 7/1981 Moskowitz et al.
4,283,360 A 8/1981 Henmi et al.
4,386,960 A 6/1983 Iacovangelo et al.
4,415,528 A 11/1983 Wiech, Jr.
4,419,413 A 12/1983 Ebihara
4,472,350 A 9/1984 Urano
4,475,344 A 10/1984 Mumford et al.
4,535,518 A 8/1985 Jaqua
4,590,769 A 5/1986 Lohmann et al.
4,615,735 A 10/1986 Ping
4,661,315 A 4/1987 Wiech, Jr.
4,702,073 A 10/1987 Melconian
4,708,838 A 11/1987 Bandyopadhyay et al.
4,734,237 A 3/1988 Fanelli et al.
4,765,950 A 8/1988 Johnson
4,780,437 A 10/1988 Smith
4,783,297 A 11/1988 Ito et al.
4,792,297 A 12/1988 Wilson
4,816,072 A 3/1989 Harley et al.
4,839,138 A 6/1989 Filz
4,874,030 A 10/1989 Kuphal et al.
4,881,431 A 11/1989 Bieneck
4,898,902 A 2/1990 Nagai et al.
4,913,739 A 4/1990 Thümmler et al.
5,021,208 A 6/1991 Ludwig et al.
5,059,387 A 10/1991 Brasel
5,059,388 A 10/1991 Kihara et al.
5,064,463 A 11/1991 Ciomek
5,094,810 A 3/1992 Shira
5,098,469 A 3/1992 Rezhets
5,129,231 A 7/1992 Becker et al.
5,135,712 A 8/1992 Kijima et al.
5,155,158 A 10/1992 Kim
5,165,226 A 11/1992 Newton et al.
5,215,946 A 6/1993 Minh
5,244,623 A 9/1993 King
5,250,244 A 10/1993 Kimura et al.
5,279,787 A 1/1994 Oltrogge
5,284,615 A 2/1994 Ueda et al.
5,286,767 A 2/1994 Rohrbach et al.
5,286,802 A 2/1994 Uesugi et al.
5,307,637 A 5/1994 Stickles et al.
5,310,520 A 5/1994 Jha et al.
5,312,582 A 5/1994 Donado
5,328,657 A 7/1994 Kamel et al.
5,332,537 A 7/1994 Hens et al.
5,338,617 A 8/1994 Workinger et al.
5,350,558 A 9/1994 Kawato et al.
5,366,679 A 11/1994 Streicher
5,368,795 A 11/1994 Quadir
5,380,179 A 1/1995 Nishimura et al.
5,397,531 A 3/1995 Peiris et al.
5,398,509 A 3/1995 North et al.
5,403,542 A 4/1995 Weinl et al.
5,409,650 A 4/1995 Holme
5,415,830 A 5/1995 Zhang et al.
5,421,853 A 6/1995 Chen et al.
5,423,899 A 6/1995 Krall et al.
5,429,792 A 7/1995 Luk
5,437,825 A 8/1995 Jensen
5,450,724 A 9/1995 Kesseli et al.
5,472,143 A 12/1995 Bartels et al.
5,476,632 A 12/1995 Shivanath et al.
5,482,671 A 1/1996 Weber
5,525,293 A 6/1996 Kagawa et al.
5,547,094 A 8/1996 Bartels et al.
5,554,338 A 9/1996 Sugihara et al.
5,574,957 A 11/1996 Barnard et al.
5,590,531 A 1/1997 Desaulty et al.
5,609,655 A 3/1997 Kesseli et al.
5,641,920 A 6/1997 Hens et al.
5,665,014 A 9/1997 Sanford et al.
5,669,825 A 9/1997 Shira
5,722,032 A 2/1998 Gay
5,730,929 A 3/1998 Majumdar et al.
5,848,350 A 12/1998 Bulger
5,864,955 A 2/1999 Hirai
5,950,063 A 9/1999 Hens et al.
5,956,955 A 9/1999 Schmid
5,977,230 A 11/1999 Yang et al.
5,989,493 A 11/1999 La Salle et al.
5,993,726 A 11/1999 Huang et al.
5,993,733 A 11/1999 Kawai
6,008,281 A 12/1999 Yang et al.
6,051,184 A 4/2000 Kankawa
6,060,017 A 5/2000 Yang et al.
6,071,325 A 6/2000 Schmitt
6,075,083 A 6/2000 Peiris
6,119,459 A 9/2000 Gomez et al.
6,159,265 A 12/2000 Kinoshita et al.
6,171,360 B1 1/2001 Suzuki et al.
6,224,816 B1 5/2001 Hull et al.
6,224,823 B1 5/2001 Lindenau et al.
6,289,677 B1 9/2001 Prociw et al.
6,319,437 B1 11/2001 Elsner et al.
6,321,449 B2 11/2001 Zhao et al.
6,322,746 B1 11/2001 LaSalle et al.
6,350,407 B1 2/2002 Sakata et al.
6,399,018 B1 6/2002 German et al.
6,406,663 B1 6/2002 Göransson
6,427,446 B1 8/2002 Kraft et al.
6,428,595 B1 8/2002 Hayashi et al.
6,468,468 B1 10/2002 Neubing et al.
6,560,964 B2 5/2003 Steinhorsson et al.
6,592,787 B2 7/2003 Pickrell et al.
6,669,898 B2 12/2003 Gressel et al.
6,730,263 B2 5/2004 Ernst et al.
6,759,004 B1 7/2004 Dwivedi
6,764,643 B2 7/2004 Sagawa et al.
6,838,046 B2 1/2005 Lu et al.
6,843,955 B2 1/2005 Ghosh et al.
6,849,230 B1 2/2005 Feichtinger
6,871,773 B2 3/2005 Fukunaga et al.
6,939,509 B2 9/2005 Kochanek
7,018,583 B2 3/2006 Berger et al.
7,052,241 B2 5/2006 Decker
2002/0058136 A1 5/2002 Belhadjhamida
2002/0109260 A1 8/2002 Boechat
2003/0062660 A1 4/2003 Beard et al.
2003/0213249 A1 11/2003 Pacheco-Tougas et al.
2005/0036898 A1 2/2005 Sweetland
2005/0254987 A1 11/2005 Azzi et al.
2006/0127268 A1 6/2006 Yano et al.
2007/0017817 A1 1/2007 Mueller et al.
2007/0020135 A1 1/2007 Jackson et al.
2007/0102572 A1 5/2007 Bohdal
2007/0104585 A1 5/2007 Ochiai et al.

FOREIGN PATENT DOCUMENTS

CA 990978 6/1976
CA 996784 9/1976
CA 2230994 3/1997
CA 2204841 11/1997
CA 2342328 3/2000
CA 2347639 4/2000
CA 2327759 5/2001

| | | | |
|---|---|---|---|
| CA | 2388359 | | 5/2001 |
| CA | 2418265 | | 2/2002 |
| CA | 2381828 | | 10/2002 |
| DE | 102005036950 | | 2/2007 |
| EP | 0 511 428 | B1 | 9/1996 |
| EP | 1 046 449 | B8 | 10/2000 |
| EP | 1107842 | | 6/2001 |
| JP | 03 039405 | A | 2/1991 |
| JP | 08 025151 | A | 1/1996 |
| JP | 08260005 | A | 10/1996 |
| WO | WO 97 38811 | A | 10/1997 |
| WO | WO 00/12248 | | 3/2000 |
| WO | WO 2005/030417 | | 4/2005 |
| WO | WO 2006/096982 | A1 | 9/2006 |
| WO | WO 2007112727 | | 10/2007 |

OTHER PUBLICATIONS

U.S. Appl. No. 60/139,354, filed Jun. 15, 1999, Lasalle, et al.

U.S. Appl. No. 11/551,021, filed Oct. 19, 2006, Stastny et al.

Powder Metallurgy 2007 Facts- "A Growth Industry Vital to Many Products"; Metal Powder Industries Federation, 2007.

Power Injection Moulding International (PIM International) "Flexibility Helps MIM Producer Meet the Demands of a Broad Client Base", 2006.

"An Introduction to Powder Metallurgy Materials and Design", Isabel J van Rooyen, Metals and Metals Processes, CSIR, Private bag X28, Auckland Park, 2006, South Africa.

NMC: "Enhanced Powder Metallurgy Processing of Superalloys for Aircraft Engine Components" 2005.

Nato: "Powder Injection Molding (PIM) for Low Cost Manufacturing of Intricate Parts to Net-Shape", Eric Baril et al., pp. 7-1 to 7-12, 2006.

Nato: "Metal Injection Moulding: A Near Net Shape Fabrication Method for the Manufacture of Turbine Engine Component", Benoit Julien et al., pp. 8-1 to 8-16, 2006.

Polymer Technologies, Inc.; "Plastic and Metal Injection Molding"; www.polymertechnologies.com, 2006.

Phillips Plastics Corporation; "MIM Metal Injection Molding Design Guide"; Nov. 12, 2004; www.phillipsmetals.com.

Egide; "Advanced Material Injection Moulding (AMIM)" 2006.

"The MIM Process"; www.epma.com, 1999.

"Powder Injection Molding"; www.powdermetinc.com/Technology.htm, 2006.

COBEF (Congresso Braileiro de Engenharia de Fabricacao); Paulo César G. Felix; Philip Frank Blazdel; Ricardo Emilio F.Q Nogueria; "*Production of Complex Parts by Low-Pressure Injection Molding of Granite Powders*" 2001.

J.E. Zorzi; C.A. Perottoni; J.A. H. de Jornada; "Wax-Based Binder for Low-Pressure Injection Molding and the Robust Proudction of Ceramic Parts" 2004.

Azom.com; "Powder Injection Moulding of Metals, Ceramics and Metal Matrix Composites"; www.azom.com, Feb. 1999.

Ceramic Industry; Ceratechno '06; Nov. 7-11, 2006; "Advancing Components with Low-Pressure Injection Molding"; www.ceramicindustry.com.

"Injection Molding Microstructures"; www.ecs.umass.edu, 2006.

TEMS—a division of ND Industries, Inc.; "Low Pressure Injection Overmolding Ruggedizing Electrical/Electronic Components"; www.temsnd.com, Mar. 7, 2006.

Peltsman; "Low Pressure Injection Molding"; www.pelcor.com, 2006.

Peltsman; "Automatic LPM Machine MIGL -37"; www.pelcor.com, 2006.

Axom.com; "Low Pressure Powder Injection Moulding of Metals, Ceramics and Metal Matrix Composites"; www.azom.com, 1999.

Goceram; "Medium Pressure Powder Injection Molding (MEDPIMOLD) Process"; www.goceram.com, 2006.

Goceram; "Medium Pressure Injection Moulding Machines"; www.goceram.com, 2006.

METHOD FOR MANUFACTURING OF FUEL NOZZLE FLOATING COLLAR

TECHNICAL FIELD

The invention relates generally to gas turbine engine combustors and, more particularly, to a method of manufacturing a fuel nozzle floating collar therefor.

BACKGROUND OF THE ART

Gas turbine combustors are typically provided with floating collar assemblies or seals to permit relative radial or lateral motion between the combustor and the fuel nozzle while minimizing leakage therebetween. Machined floating collars are expensive to manufacture at least partly due to the need for an anti-rotating tang or the like to prevent rotation of the collar about the fuel nozzle tip. This anti-rotation feature usually prevents the part from being simply turned requiring relatively expensive milling operations and results in relatively large amount of scrap material during machining.

There is thus a need for further improvements in the manufacture of fuel nozzle floating collars.

SUMMARY

In one aspect, there is provided a method of manufacturing a floating collar adapted to be slidably engaged on a fuel nozzle for providing a sealing interface between the fuel nozzle and a combustor wall, the method comprising: metal injection moulding a generally cylindrical part having an axis, a collar portion and a sacrificial portion, the sacrificial portion including at least a shoulder projecting radially inwardly from one end of said collar portion along an inner circumferential wall of the collar portion, the shoulder and the circumferential wall defining a corner, and while the cylindrical part is still in a substantially dry green condition forming a chamfer at said one end of said collar portion on an inside diameter of the collar portion by applying axially opposed shear forces on opposed sides of the corner to shear off the sacrificial portion from said collar portion along a shearing line extending angularly outwardly from said corner.

In a second aspect, there is provided a method for manufacturing a floating collar adapted to provide a sealing interface between a fuel nozzle and a gas turbine engine combustor, comprising: a) metal injection moulding a green part including a floating collar portion and a feed inlet portion, the feed inlet portion bearing injection marks corresponding to the points of injection, b) separating the feed inlet portion from the floating collar portion to obtain a floating collar free of any injection marks, and c) debinding and sintering the floating collar portion Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
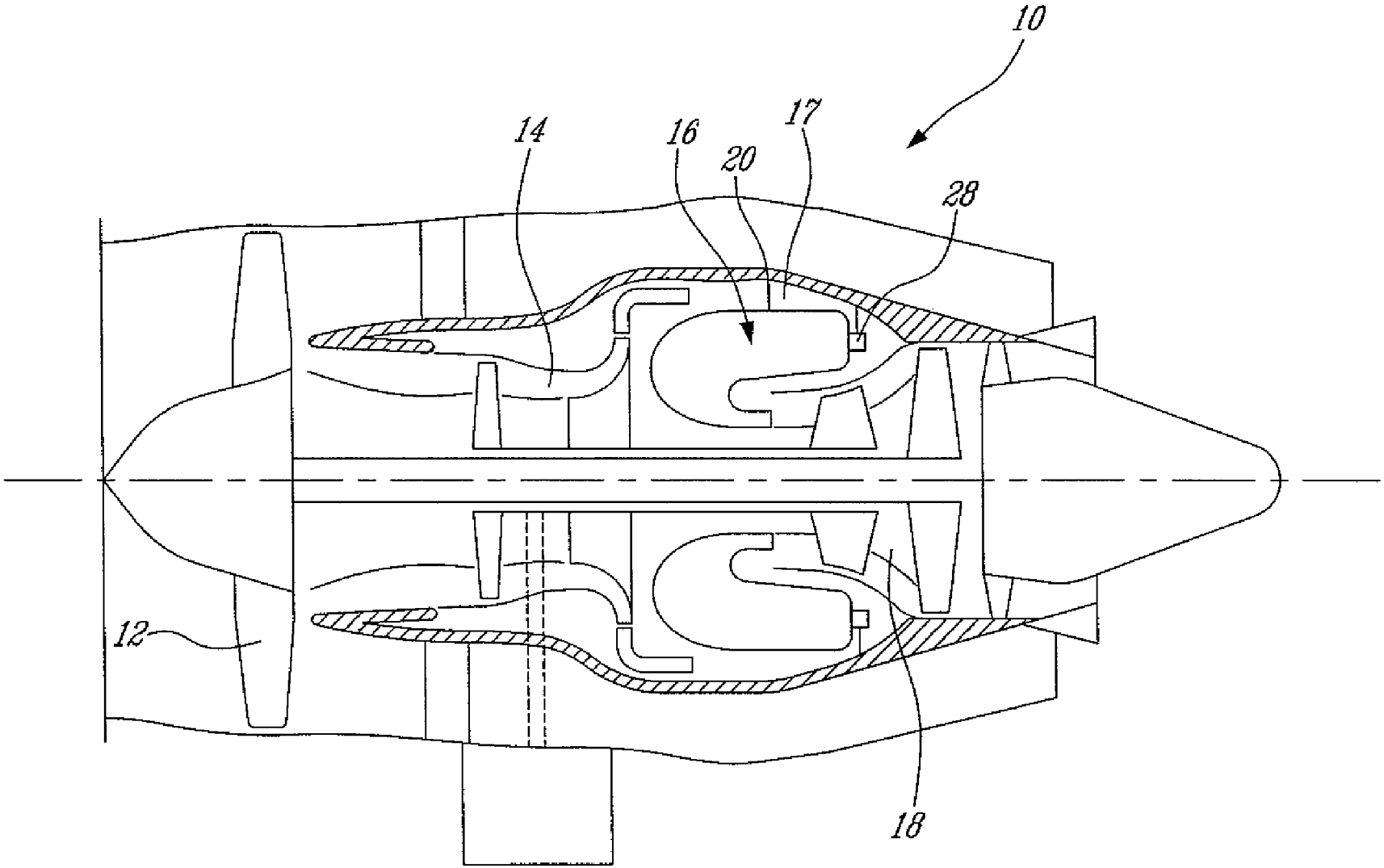
FIG. 1 is a schematic cross-sectional view of a gas turbine engine having an annular combustor.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
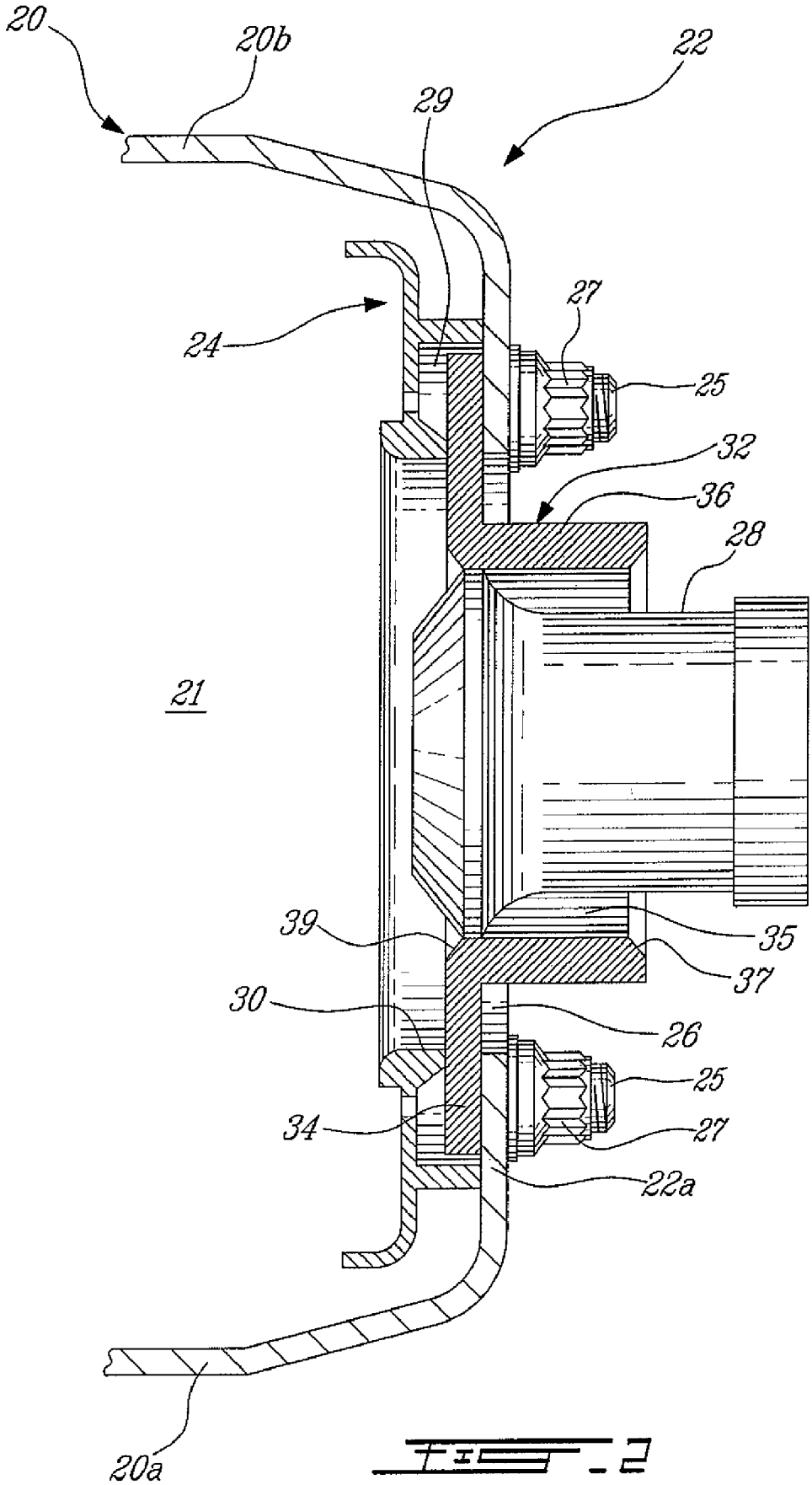
FIG. 2 is an enlarged cross-sectional view of a dome portion of the combustor illustrating a floating collar slidably mounted about a fuel nozzle tip and axially trapped between a heat shield and a combustor dome panel.

The combustor 16 is housed in a plenum 17 supplied with compressed air from compressor 14. The combustor 16 has a reverse flow annular combustor shell 20 including a radially inner liner 20*a* and a radially outer liner 20*b* defining a combustion chamber 21. As shown in FIG. 2, the combustor shell 20 has a bulkhead or inlet dome portion 22 including an annular end wall or dome panel 22*a*. A plurality of circumferentially distributed dome heat shields (only one being shown at 24) are mounted inside the combustor 16 to protect the dome panel 22*a* from the high temperatures in the combustion chamber 21. The heat shields 24 can be provided in the form of high temperature resistant casting-made arcuate segments assembled end-to-end to form a continuous 360° annular band on the inner surface of the dome panel 22*a*. Each heat shield 24 has a plurality of threaded studs 25 extending from a back face thereof and through corresponding mounting holes defined in the dome panel 22*a*. Fasteners, such as self-locking nuts 27, are threadably engaged on the studs from outside of the combustor 16 for securely mounting the dome heat shields 24 to the dome panel 22*a*. As shown in FIG. 2, the heat shields 24 are spaced from the dome panel 22*a* by a distance of about 0.1 inch so as to define an air gap 29. In use, cooling air is admitted in the air gap 29 via impingement holes (not shown) defined though the dome panel 22*a* in order to cool down the heat shields 24.

A plurality of circumferentially distributed nozzle openings (only one being shown at 26) are defined in the dome panel 22*a* for receiving a corresponding plurality of air swirler fuel nozzles (only one being shown at 28) adapted to deliver a fuel-air mixture to the combustion chamber 21. A corresponding central circular hole 30 is defined in each of the heat shields 24 and is aligned with a corresponding fuel nozzle opening 26 for accommodating an associated fuel nozzle 28 therein. The fuel nozzles 28 can be of the type generally described in U.S. Pat. No. 6,289,676 or 6,082,113, for example, and which are incorporated herein by reference.

Figure 3:
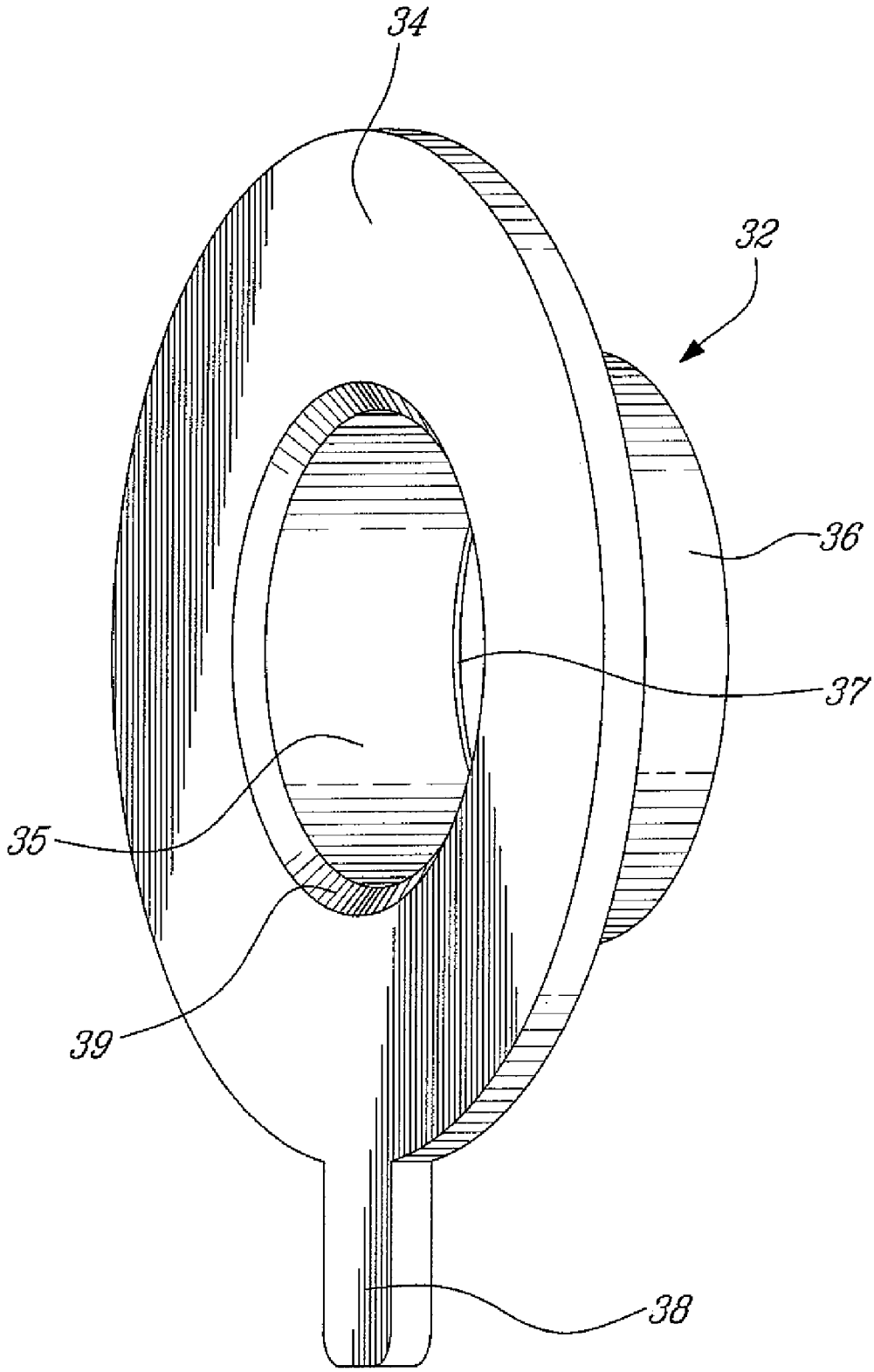
FIG. 3 is an isometric view of the floating collar shown in FIG. 2.

As shown in FIGS. 2 and 3, each fuel nozzle 28 is associated with a floating collar 32 to facilitate fuel nozzle engagement with minimum air leakage while maintaining relative movement of the combustor 16 and the fuel nozzle 28. Each floating collar 32 comprises an axially extending cylindrical portion 36 and a radially extending flange portion 34 integrally provided at a front end of the axially extending cylindrical portion 36. The axially extending cylindrical portion 36 defines a central passage 35 for allowing the collar 32 to be axially slidably engaged on the tip portion of the fuel nozzle 28. First and second inner diameter chamfers 37 and 39 are provided at opposed ends of the collar 32 to eliminate any sharp edges that could interfere with the sliding movement of the collar 32 on the fuel nozzle 28. The chamfers 37 and 39 extend all around the inner circumference of the collar 32. The radially extending flange portion 34 is axially sandwiched in the air gap 29 between the heat shield 24 and the dome panel 22*a*. An anti-rotation tang 38 extends radially from flange portion 34 for engagement in a corresponding slot (not shown) defined in a rearwardly projecting surface of the heat shield 24.

Figure 4:
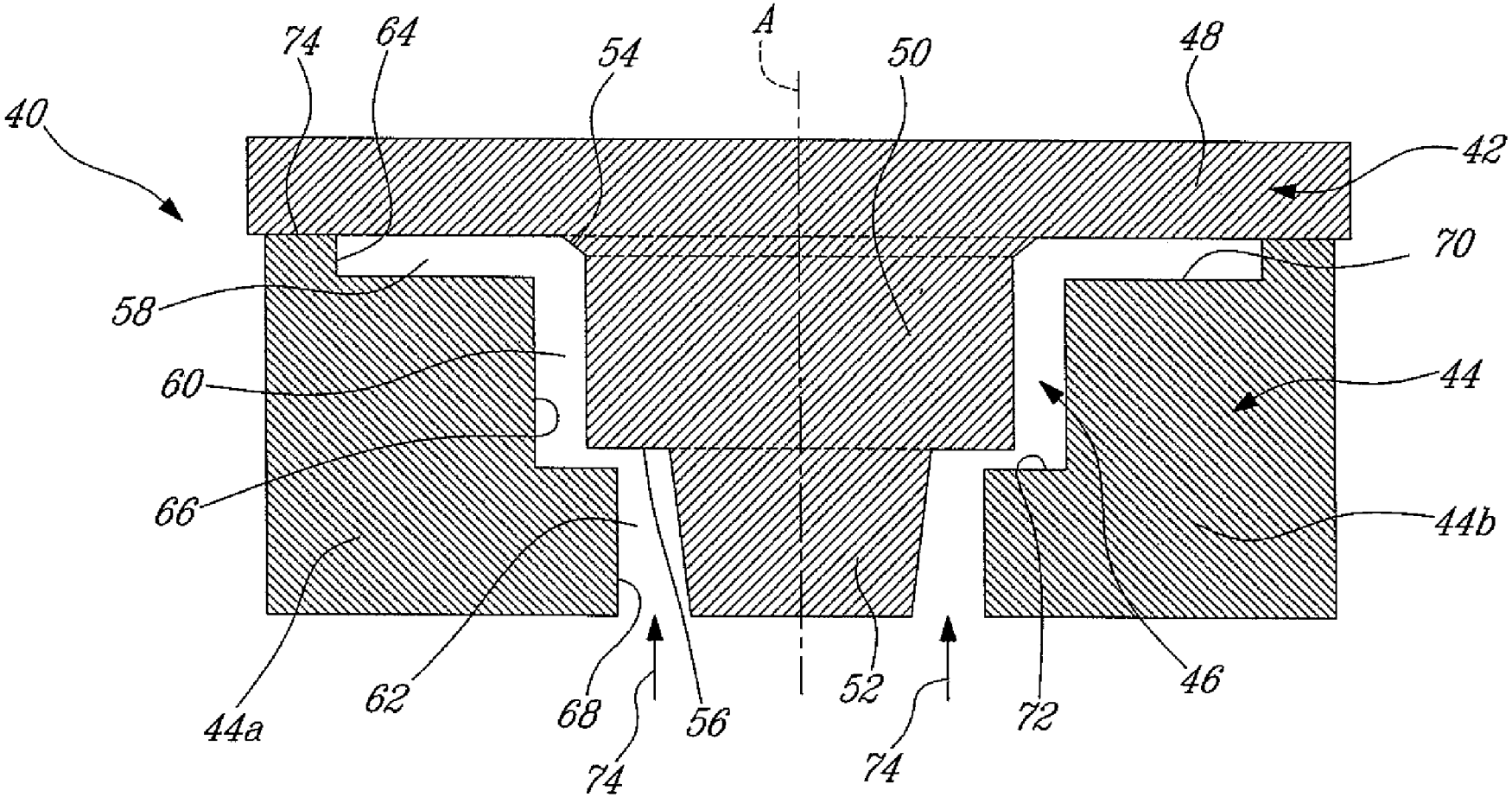
FIG. 4 is a cross-sectional view of a mould used to form the floating collar.

As can be appreciated from FIG. 4, the floating collar 32 can be produced by metal injection moulding (MIM). The MIM process is preferred as being a cost-effective method of forming precise net-shape metal components. The MIM process eliminates costly secondary machining operations. The manufacturing costs can thus be reduced. The floating collar 32 is made from a high temperature resistant powder injection moulding composition. Such a composition can include powder metal alloys, such as IN625 Nickel alloy, or ceramic powders or mixtures thereof mixed with an appropriate binding agent. Other high temperature resistant compositions could be used as well. Other additives may be present in the composition to enhance the mechanical properties of the floating collar (e.g. coupling and strength enhancing agents).

As shown in FIG. 4, the molten metal slurry used to form the floating collar 32 is injected in a mould assembly 40 comprising a one-piece male part 42 axially insertable into a two-piece female part 44. The metal slurry is injected in a mould cavity 46 defined between the male part 42 and the female part 44. The gap between the male and female parts 42 and 44 corresponds to the desired thickness of the walls of the floating collar 32. The female part 44 is preferably provided in the form of two separable semi-cylindrical halves 44*a* and 44*b* to permit easy unmoulding of the moulded green part.

The male part 42 has a disc-shaped portion 48, an intermediate cylindrical portion 50 projecting axially centrally from the disc-shaped portion 48 and a terminal frusto-conical portion 52 projecting axially centrally from the intermediate cylindrical portion 50 and tapering in a direction away from the intermediate cylindrical portion 50. An annular chamfer 54 is defined in the male part 42 between the disc-shaped portion 48 and the intermediate cylindrical portion 50. The annular chamfer 54 is provided to form the inner diameter chamfer 39 of the collar 32. An annular shoulder 56 is defined between the intermediate cylindrical portion 50 and the bottom frusto-conical portion 52.

The female part 44 defines a central stepped cavity including a rear shallow disc-like shaped cavity 58, a cylindrical intermediate cavity 60 and a front or feed inlet cylindrical cavity 62. The disc-like shaped cavity 58, the intermediate cavity 60 and the feed cavity 62 are aligned along a central common axis A. The disc-like shaped cavity 58 has a diameter d1 greater than the diameter d2 of the intermediate cavity 60. Diameter d2 is, in turn, greater than the diameter d3 of the feed cavity 62. The disc-like shaped cavity 58, the intermediate cavity 60 and the feed cavity 62 are respectively circumscribed by concentric cylindrical sidewalls 64, 66 and 68. First and second axially spaced-apart annular shoulders 70 and 72 are respectively provided between the disc-like cavity 58 and the intermediate cavity 60, and the intermediate cavity 60 and the front cavity 62.

After the male part 42 and the female part 44 have been inserted into one another with a peripheral portion of the disc-like shaped portion 48 of the male part 42 sealingly abutting against a corresponding annular surface 74 of the female part 44, the mould cavity 46 is filled with the feedstock (i.e. the metal slurry) by injecting the feedstock axially endwise though the feed cavity 62 about the frusto-conical portion 52, as depicted by arrows 74.

Figure 5:
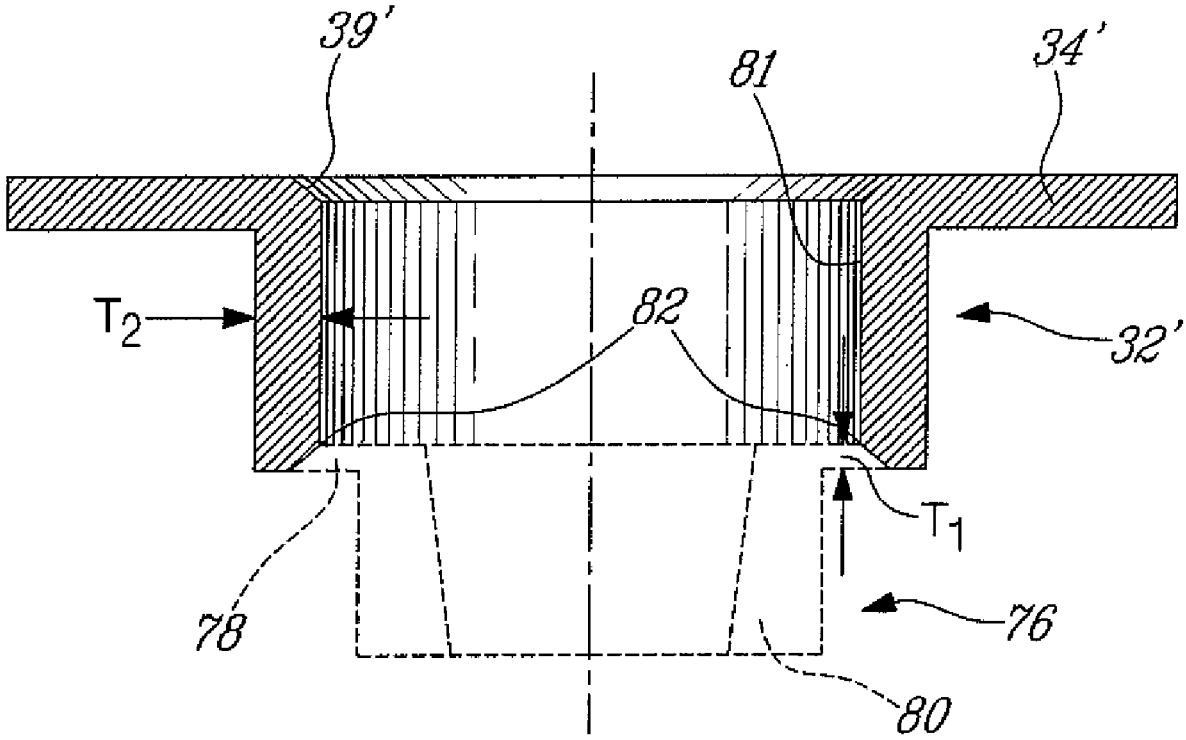
FIG. 5 is a cross-sectional view of the moulded green part obtained from the metal injection moulding operation, the feed inlet material to be discarded being shown in dotted lines.

After a predetermined setting period, the mould assembly 40 is opened to reveal the moulded green part shown in FIG. 5. The moulded green part comprises a floating collar portion 32' and a sacrificial or "discardeable" feed inlet portion 76 (shown in dotted lines) to be separated from the collar portion 32' and discarded. As can be appreciated from FIG. 5, the collar portion 32' has a built-in flange 34' and an inner diameter chamfer 39' respectively corresponding to flange 34 and chamfer 39 on the finished collar product shown in FIG. 3, but still missed the inner diameter chamfer 37 at the opposed end of the floating collar. As will be seen hereinafter, the chamfer 37 is subsequently formed by separating the sacrificial portion 76 from the collar portion 32'.

In the illustrated example, the sacrificial feed inlet portion 76 comprises a shoulder 78 extending radially inwardly from one end of the collar portion 32' opposite to flange 34' and an axially projecting hollow cylindrical part 80. The shoulder 78 extends all around the entire inner circumference of the collar portion 32'. The shoulder 78 and the cylindrical wall 81 of the collar portion 32' define a sharp inner corner 82. The sharp inner corner 82 is a high stress concentration region where the moulded green part will first start to crack if a sufficient load is applied on shoulder 78. Also can be appreciated from FIG. 5, the thickness T1 of the shoulder 78 is less than the wall thickness T2 of the collar portion 32'. The shoulder 78 is thus weaker than the cylindrical wall 81 of the collar 32', thereby providing a suitable "frangible" or "breakable" area for separating the sacrificial feed inlet portion 76 from the collar portion 32'.

Figure 6:
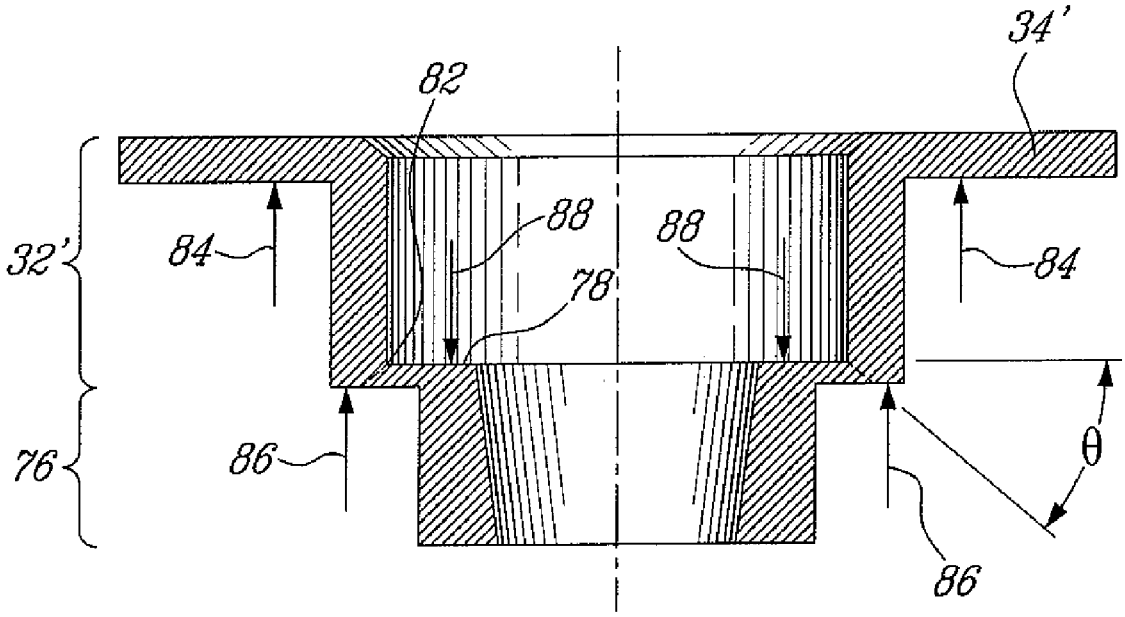
FIG. 6 is a cross-sectional schematic view illustrating how the moulded green part is sheared to separate the collar from the material to be discarded.

As schematically shown in FIG. 6, the sacrificial feed inlet portion 76 can be separated from the collar portion 32' by shearing. The shearing operation is preferably conducted while the part is still in a dry green state. In this state, the part is brittle and can therefore be broken into pieces using relatively small forces. As schematically depicted by arrows 84 and 86, the moulded green part is uniformly circumferentially supported underneath flange 34' and shoulder 78. An axially downward load 88 is applied at right angles on the inner shoulder 78 uniformly all along the circumference thereof. A conventional flat headed punch (not shown) can be used to apply load 88. The load 88 or shearing force is applied next to inner corner 82 and is calibrated to shear off the sacrificial portion 80 from the collar portion 32'. As shown in dotted lines in FIG. 6, the crack initiates from the corner 88 due to high stress concentration and extends angularly outwardly towards the outer support 86 at an angle θ comprised between 40-50 degrees, thereby leaving a sheared chamfer 37' (see FIG. 7) on the inner diameter of the separated collar portion 32'. The shear angle θ can be adjusted by changing the diameter of the outer support 86. For instance, if the diameter of the outer support 86 is reduced so as to be closer to the inner corner 82, the shear angle θ will increase. Accordingly, the location of the intended shear line can be predetermined to consistently and repeatedly obtain the desired inner chamfer at the end of the MIM floating collars. This avoids expensive secondary machining operations to form chamfer 37. The sheared chamfer 37 has a surface finish which is a rougher than a machined or moulded surface, but is designed to remain within the prescribed tolerances. There is thus no need to smooth out the surface finish of the sheared chamfer 37. Also, since the sacrificial portion 76 bears the injection marks left in the moulded part at the points of injection, there is no need for secondary machining of the remaining collar portion 32' in order to remove the injection marks.

Figure 7:
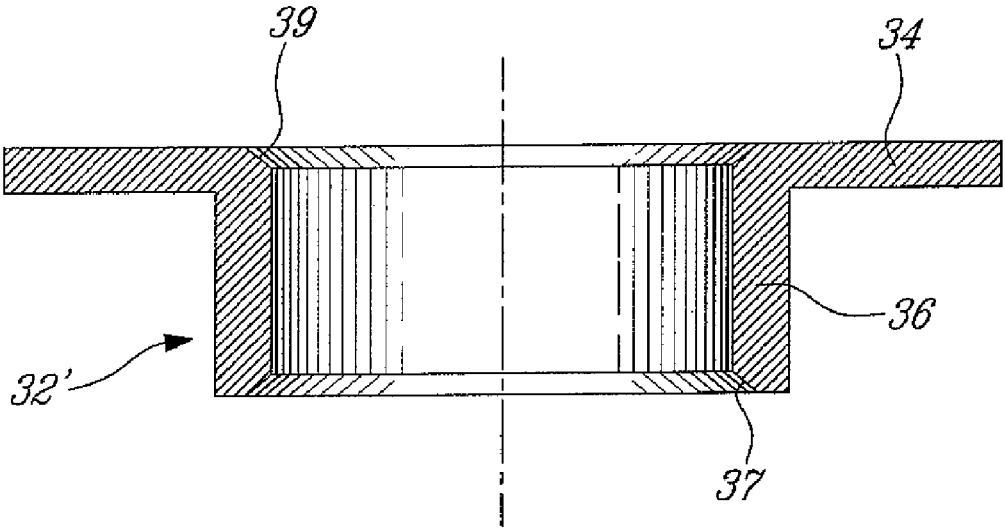
FIG. 7 is a cross-section view of the collar after the shearing operation, the sheared surface forming a chamfer on the inside diameter of the collar.

Once separated from the collar portion 32', the sacrificial feed inlet portion 76 can be recycled by mixing with the next batch of metal slurry. The remaining collar portion 32' obtained from the shearing operation is shown in FIG. 7 and is then subject to conventional debinding and sintering operations in order to obtain the final net shape part shown in FIG. 3.

The above description is meant to be exemplary only, and one skilled in the art will recognize that changes may be made to the embodiments described without departing from the scope of the invention disclosed. For example, a line of weakening could be integrally moulded into the part or cut into the surface of the moulded part to provide a stress concentration region or frangible interconnection between the portion to be discarded and the floating collar portion. Also, it is understood that the part to be discarded could have various configurations and is thus limited to the configuration exemplified in FIGS. 5 and 6. Still other modifications which fall within the scope of the present invention will be apparent to those skilled in the art, in light of a review of this disclosure, and such modifications are intended to fall within the appended claims.

What is claimed is:

1. A method of manufacturing a floating collar adapted to be slidably engaged on a fuel nozzle for providing a sealing interface between the fuel nozzle and a combustor wall, the method comprising: metal injection moulding a generally cylindrical part having an axis, a collar portion and a sacrificial portion, the sacrificial portion including at least a shoulder projecting radially inwardly from one end of said collar portion along a circumferential wall of the collar portion, the shoulder and the circumferential wall defining a corner, and while the cylindrical part is still in a substantially dry green condition, forming a chamfer at said one end of said collar portion on an inside diameter of the collar portion by applying axially opposed shear forces on opposed sides of the corner to shear off the sacrificial portion from said collar portion along a shearing line extending angularly outwardly from said corner.

2. The method defined in claim 1, wherein said shoulder has a shoulder thickness which is less than a wall thickness of said circumferential wall of said collar portion.

3. The method defined in claim 1, wherein metal injection moulding comprises injecting feedstock in a region of a mould corresponding to the sacrificial portion.

4. The method defined in claim 1, comprising removing injection marks left in a surface of the generally cylindrical part as a result of the metal injection moulding step by separating the sacrificial portion from the collar portion, the injection marks being contained in the sacrificial portion.

5. The method defined in claim 1, wherein forming a chamfer comprises applying an axial load on said shoulder and supporting said one end of said collar portion radially outwardly of said corner.

6. The method defined in claim 1, further comprising debinding and sintering the collar portion after the sacrificial portion has been separated therefrom.

* * * * *